United States Patent [19]

St. Germain

[11] 3,941,208

[45] Mar. 2, 1976

[54] SAFETY BELT CONSTRUCTION

[76] Inventor: Dennis St. Germain, 3350 Bancroft Drive, Aston, Pa. 19014

[22] Filed: Nov. 29, 1974

[21] Appl. No.: 528,086

[52] U.S. Cl. ..... 182/3; 24/200; 2/311

[51] Int. Cl.[2] ..... A62B 35/00

[58] Field of Search..... 182/3, 4, 5, 6, 7; 24/200; 2/311

[56] References Cited

UNITED STATES PATENTS

| | | | |
|---|---|---|---|
| 1,409,702 | 3/1922 | Gill | 182/3 |
| 2,303,954 | 12/1942 | Roke | 182/3 |
| 2,459,545 | 1/1949 | Schultz | 182/3 |
| 2,981,994 | 5/1961 | White | 24/200 |

*Primary Examiner*—Reinaldo P. Machado
*Attorney, Agent, or Firm*—Anthony J. McNulty

[57] ABSTRACT

A safety belt construction includes a buckle attached to one end of a belt for retaining the belt in a closed condition about the body of a wearer, and a safety line forming a unitary extension of the buckle and adapted to be secured through a connector to suitable anchorage in a structure being worked upon.

7 Claims, 6 Drawing Figures

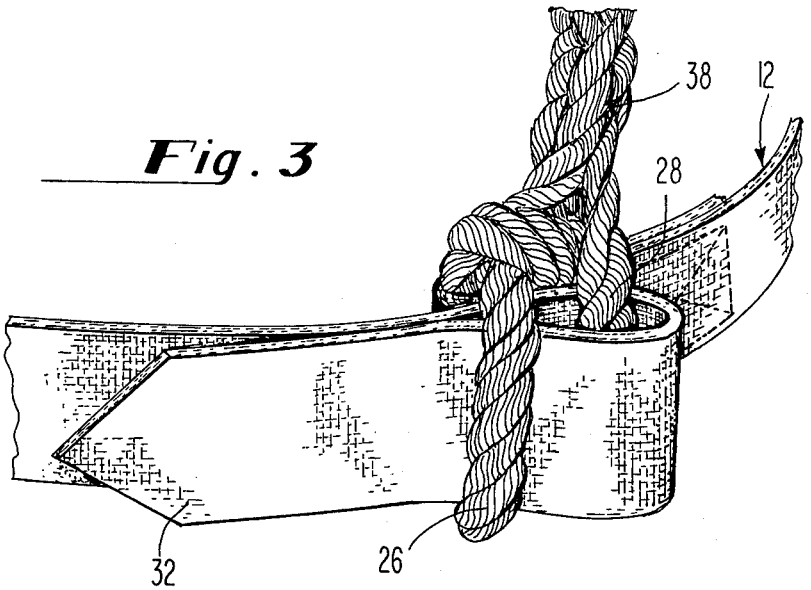
Fig. 3
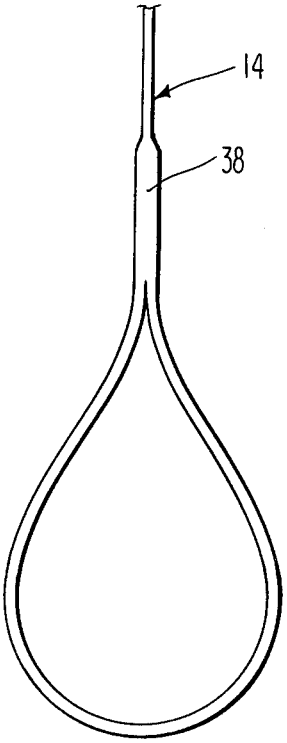
Fig. 4A
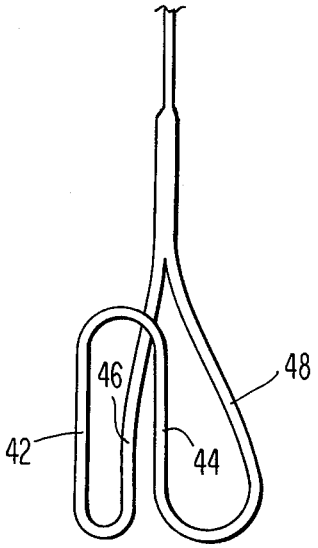
Fig. 4B
Fig. 4C
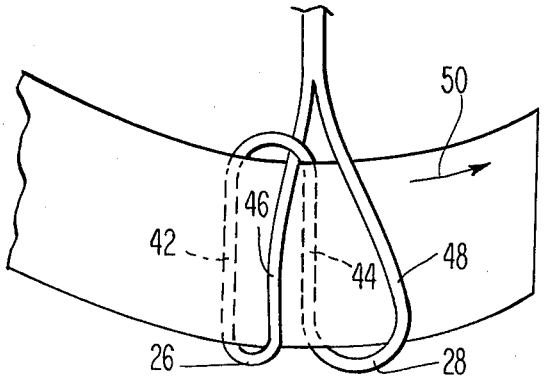

SAFETY BELT CONSTRUCTION

BACKGROUND OF THE INVENTION

1. Field of the Invention

This invention relates to a safety belt construction, and more specifically to a safety belt construction of the type including a belt adapted to be secured about the body a wearer, and a safety line adapted to be secured through a connector to suitable anchorage on a structure being worked upon to prevent a workman from falling from the structure.

2. Description of the Prior Art

Safety belt constructions which are designed to protect a wearer from injury be checking a fall are well known in the prior art. These constructions generally include a buckle at one end of a belt for retaining the belt in a closed condition about the body of a wearer. In addition, a separate connector is attached to the belt, and one end of a safety line is secured thereto. The other end of the safety line generally includes a connector which is adapted to be attached to suitable anchorage in a structure which is being worked upon to thereby check the fall of the wearer. A safety belt construction of the above-described type is disclosed in U.S. Pat. No. 2,651,446, issued to Rose.

The inclusion of both a safety line connector and a buckle attached to a belt of a safety belt construction enhances material costs. In addition, the fabrication of such a safety belt construction is somewhat complicated by the fact that both the safety line connector and buckle must be separately secured to the belt.

SUMMARY OF THE INVENTION

This invention relates to a safety belt construction which requires less components, and is simpler to fabricate than the above-described prior art construction. Specifically, the safety belt construction of this invention includes a buckle which is fastened to one end of a belt for retaining the belt about the body of a wearer, and a safety line forming a unitary extension of the buckle, and adapted to be secured through a connector to suitable anchorage in a structure being worked upon.

In the preferred embodiment of this invention, the buckle is a multi-coil friction buckle which is secured to a closed loop at one end of the belt, and the safety line is a continuous extension of the buckle, and includes a connector at its free end for attachment to suitable anchorage in a structure being worked upon. Preferably, the safety line and friction buckle are formed from a single multi-strand rope, and the friction buckle includes two coils. The free end of the belt, i.e. the end opposite that containing the buckle, is passed through both coils, then over one and under the other to frictionally lock the belt in a closed condition about the body of a wearer.

The safety belt construction of this invention does not require the inclusion of a separate connector attached to the belt for receiving a safety line. Accordingly, the construction of this invention includes less components, and is simpler to fabricate than prior art constructions which require the inclusion of a separate safety line connector attached to the belt.

Other objects and advantages of this invention will become apparent upon reading the detailed description which follows, taken in conjunction with the drawings.

BRIEF DESCRIPTION OF THE DRAWINGS

FIG. 3 is a perspective view showing the manner in which the buckle is employed to secure the belt in a closed condition about the body of a wearer; and FIGS. 4A, 4B and 4C are schematic views showing sequential steps in the formation of a double-coil friction buckle prior to its assembly with the belt.

DESCRIPTION OF THE PREFERRED EMBODIMENT OF THE INVENTION

Figure 1:
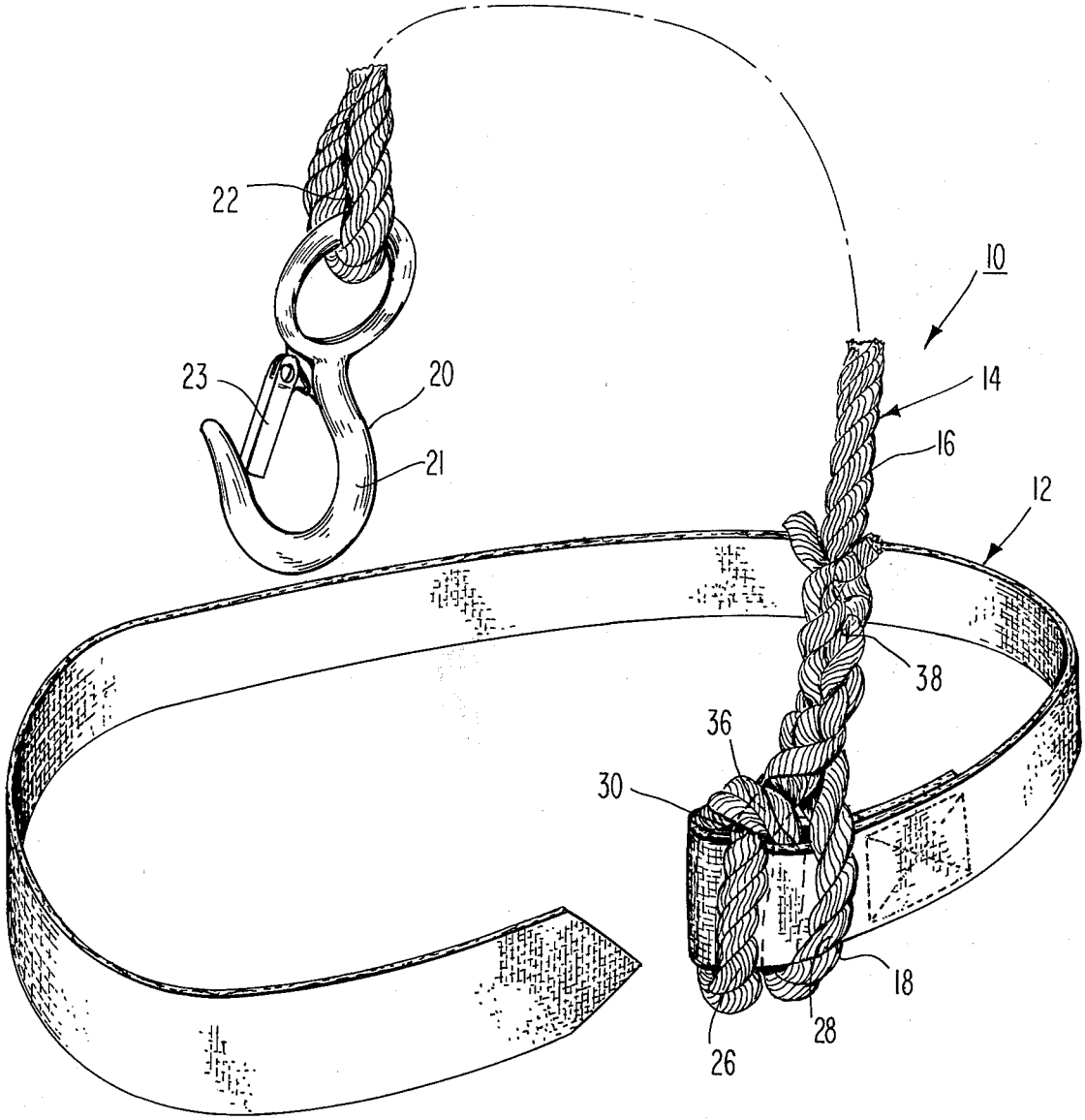
FIG. 1 is a perspective view of a safety belt construction according to this invention.

Referring to FIG. 1, the safety belt construction 10 of this invention includes a belt 12, and a multi-strand rope 14 which is both a safety line 16 and a double-coil friction buckle 18. A connector hook 20 is secured through a closed loop 22 at one end of the safety line 16. The connector hook 20 can be of any desired construction, and in the preferred embodiment includes a substantially U-shaped member 21, and a finger 23 that is spring biased to close the open end of said U-shaped member 21. The loop 22 is closed by a splice (not shown) which is formed by intertwining the individual strands of rope 14 in a known manner.

The particular materials from which the belt 12 and multi-strand rope 14 are formed is not considered to be a limitation on the present invention. However, in the preferred embodiment of this invention, the belt 12 is formed from nylon webbing, and the rope 14 is formed from nylon strands.

Referring again to FIG. 1, the double-coil friction buckle 18 includes adjacent coils 26 and 28 which are secured to the belt 12 through a closed belt loop 30. The belt loop 30 can be formed in a conventional manner by folding the end of the belt back upon the main body thereof, and then sewing the belt in this condition. Alternatively, other conventional fastening means can be employed to form the closed belt loop 30.

Referring to FIG. 3, the belt 12 is secured about the waist of a wearer by passing free end 32 of the belt through both of the coils 26 and 28, and then back over coil 28 and through coil 26. After the free end 32 of the belt has been secured through the buckle the free end can be folded between the wearer's body and the belt, if desired, to prevent it from dangling.

Figure 2:
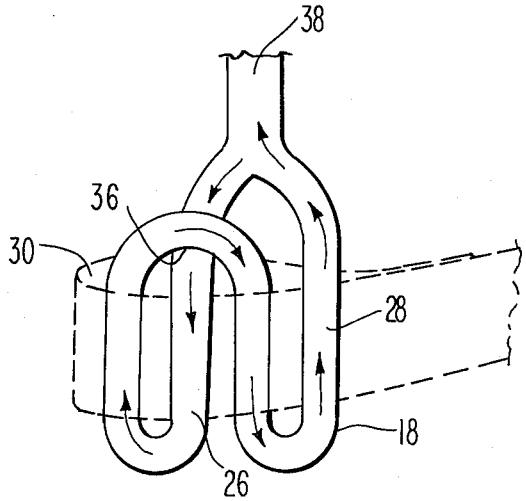
FIG. 2 is an expanded schematic view of a belt loop and buckle forming a part of the safety belt construction shown in FIG. 1.

Referring to FIGS. 1 and 2, the double-coil friction buckle 18 is formed by passing one end of the multi-strand rope 14 around and through the belt loop 30 as indicated by the arrows. Note that the coil 26 is closed by the passage of rope 14 around itself adjacent one side of the belt. This forms a friction junction 36 to maintain the desired clearance between the coil 26 and the belt 12 to permit the free end 32 to be passed through it in an easy manner. Coil 28 is closed at one end by splice 38 which is formed by intertwining the individual strands of rope 14 together in the same manner as the splice which closes loop 22.

A workman wearing the safety belt construction 10 will generally be leaning back to thereby tension the safety line 16. This tensioning of the safety line causes the individual strands thereof to tighten, and thereby tighten both the splice which closes loop 22 and the splice 38. Moreover, this tensioned condition of the safety line tightens the buckle 18 to firmly retain the free end 32 of the belt 12. Accordingly, the forces imposed upon the safety belt construction 10 during its use insure that the construction will work in a safe and reliable manner.

FIGS. 4A, 4B and 4C show sequential steps in forming the double-coil friction buckle 18 at one end of the multi-strand rope 14 prior to assembling the rope with the belt 12. Referring first to FIG. 4A, the end of the multi-strand rope 14 is spliced at 38 to form a closed loop 40. Referring to FIG. 4B, a forward section of the loop 40 is folded over a rear section of said loop with the folded strand sections 42 and 44 interdigitated with the unfolded strand sections 46 and 48. Referring to FIG. 4C, the unfolded segments 46 and 48 are brought together to form the upper runs of the coils 26 and 28, and the folded strand sections 42 and 44 are brought together to form the lower runs of the coils 26 and 28. The end of the belt 12 is then passed through the coils in the direction indicated by arrow 50 on FIG. 4C. After the belt is passed through the coils, it can then be folded back upon itself and secured in that condition to form the closed belt loop 30 shown in FIGS. 1 and 2.

Having described my invention, I claim:

1. A safety belt construction including:

A. a belt adapted to be positioned about the body of a wearer, said belt having opposed ends;

B. a flexible buckle attached to said belt adjacent one of said opposed ends and including a passageway through which the other of said opposed ends is inserted to adjust the belt to a desired closed condition about the body of the wearer, said buckle including means for retaining said belt in its adjusted, closed condition; and C. a safety line forming a unitary extension of said buckle and adapted to be secured through a connector to suitable anchorage in a structure being worked upon.

2. The safety belt construction according to claim 1, including a connector attached to the safety line, said connector being adapted to be attached to suitable anchorage in a structure being worked upon.

3. The safety belt construction according to claim 1, wherein said buckle is a multi-coil friction buckle secured to the belt through a closed loop at one end of said belt.

4. The safety belt construction according to claim 3, wherein said multi-coil friction buckle and safety line are formed from a single multi-strand rope.

5. The safety belt construction according to claim 4, wherein said multi-coil friction buckle includes two coils.

6. The safety belt construction according to claim 4, wherein one of the coils of the friction buckle is closed at one end by a friction junction formed by overlapping sections of the multi-strand rope.

7. The safety belt construction according to claim 6, wherein one end of the other coil is closed by the intertwining of the strands of the multi-strand rope to form a splice.

* * * * *